United States Patent [19]

Stull

[11] Patent Number: 5,071,017

[45] Date of Patent: Dec. 10, 1991

[54] CLOSURE CAP CONSTRUCTION WITH SLITTED FLEXIBLE DIAPHRAGM

[76] Inventor: Iene Stull, 1086 Hacklebarney Rd., Chester Township, Morris County, N.J. 07930

[21] Appl. No.: 655,830

[22] Filed: Feb. 15, 1991

[51] Int. Cl.[5] ..... B65D 51/16; B65D 51/20; B65D 25/00; B65D 5/72

[52] U.S. Cl. ..... 215/260; 215/114; 215/247; 220/203; 220/209; 220/229; 220/257; 220/89.1; 222/490; 222/491; 222/494

[58] Field of Search ..... 215/260, 247, 270, 271, 215/263, 17, 11.4; 220/209, 203, 229, 240, 257, 89.1, 374; 222/490, 491, 494, 548, 421

[56] References Cited

U.S. PATENT DOCUMENTS

| | | | |
|---|---|---|---|
| 1,865,764 | 7/1932 | Keenan | 220/203 X |
| 2,070,377 | 2/1937 | Simmons | 215/260 |
| 2,550,132 | 4/1951 | Woods | 222/490 |
| 2,552,715 | 5/1951 | Gray et al. | 222/490 |
| 2,667,992 | 2/1954 | Hammond et al. | 222/92 |
| 2,670,884 | 3/1954 | Swartz | 222/490 |
| 3,273,754 | 9/1966 | Lindley | 222/92 |
| 3,608,793 | 9/1971 | Van LobenSels | 222/490 |
| 4,133,457 | 1/1979 | Klassen . | |
| 4,981,229 | 1/1991 | Lanham | 215/305 X |

*Primary Examiner*—Stephen Marcus
*Assistant Examiner*—Paul A. Schwarz
*Attorney, Agent, or Firm*—H. Gibner Lehmann; K. Gibner Lehmann

[57] ABSTRACT

A valving-type closure having a resilient diaphragm provided with a portion having a through slit for the passage of fluids, the slit portion being adapted to bulge and open the slit in response to fluid pressure applied to one side thereof. The slit portion has abuttable, cooperable structures on one side, which come into forcible abutment and act to physically open the slit as the portion bulges. Preferably the abuttable structures are in the form of rings molded on the underside of the diaphragm. The slit through the diaphragm also extends through the ring, thereby forming two semi-circular ring segments. The ring segments in turn form abutment shoulders that pivot the walls of the slit away from one another when the diaphragm is bulged, thereby resulting in a more pronounced spreading force being applied to the walls, and increasing the size of the opening formed by the slit.

20 Claims, 3 Drawing Sheets

CLOSURE CAP CONSTRUCTION WITH SLITTED FLEXIBLE DIAPHRAGM

BACKGROUND OF THE INVENTION

1. Field of the Invention

This invention relates generally to closure caps for handheld dispensers, and more particularly to caps of the type having a flexible diaphragm containing one or more slits constituting normally closed valves which are adapted to momentarily open under the influence of internal liquid pressure resulting from squeezing of the dispenser by the consumer.

2. Description of the Related Art Including Information

DISCLOSED UNDER 37 CFR ∫∫1.97–1.99

In the past, a number of valving closures have been proposed, for use with tubes or other types of collapsible dispensers. Examples of known dispensers are illustrated in U.S. Pat. Nos. 2,550,132; 2,552,715; 2,667,992; 2,670,884; 3,273,754; 3,608,793; and 4,133,457.

U.S. Pat. Nos. '132, '715, '992, and '884 all disclose dispensers in the form of squeezeable tubes having resilient cap membranes each containing a slit which is normally closed and which opens under the action of pressure of the contents of the tube as it is squeezed. U.S. Pat. No. '754 shows a slitted cap wall where the openings formed by the slits are controlled by axial movement of the cap. U.S. Pat. No. '457 illustrates a squeeze bottle having a closure containing a substantially flat, slitted diaphragm across its open end. Internal pressure bulges the diaphragm, resulting in separation of the walls of the slit and permitting discharge of the dispenser contents. At opposite ends of the slits, or alternately at other locations in the diaphragm, there are small holes which have a dimension that renders them impervious to the relatively viscous liquid contained in the dispenser, but which can vent air into the dispenser to relieve the vacuum therein which occurs following dispensing.

U.S. Pat. No. '793 illustrates yet another type of dispenser for liquids such as glue, the dispenser incorporating a resilient, slitted valving member carried in an apertured body. The slit in the valving member opens under pressure, enabling product to flow through the slit and out the aperture of the body.

None of the devices noted above appears to have met with substantial commercial success. It is believed that in many instances, the design and construction of slitted-membrane type closures has suffered from drawbacks involving poor dispensing characteristics, lack of a truly drip-resistant seal, or else problems that have occurred with solidified product which tended to accumulate in the area of the slit and which interfered with or defeated proper valving operation of the closure. In particular, it is believed that hardened product forming over or around a slit in a diaphragm can effectively seal off the slit by causing the walls thereof to stick together, and thereby thwart the passage of liquid therethrough. This problem would become especially troublesome where the substance being dispensed was a glue or adhesive; similarly, other products of a creamy or viscous consistency could also cause problems if they were allowed to accumulate around the slit and to dry out or otherwise harden.

SUMMARY OF THE INVENTION

The above disadvantages and drawbacks of prior closure cap constructions of the type noted are largely obviated by the present invention, which has for one object the provision of a novel and improved slitted membrane-type closure cap construction which is simple and reliable in use over extended periods of time and with a wide variety of liquid products.

A related object of the invention is to provide an improved slitted membrane-type closure cap construction as above set forth, wherein a more positive force is available for opening the slit than was heretofore realizeable, thereby eliminating premature failure or malfunction of the closure.

A still further object of the invention is to provide an improved closure cap construction as above characterized, wherein there can be readily achieved a control of the flow rate according to the type of product being dispensed, and in relation to the viscosity thereof.

Still another object of the invention is to provide an improved closure cap construction in accordance with the foregoing, wherein the various components can be readily molded in simple mold cavities, so as to keep overall manufacturing and assembly cost to an absolute minimum.

Yet another object of the invention is to provide an improved closure cap construction of the kind indicated, wherein a reliable leak-resistant seal is obtained when the container is in storage or being shipped, while still maintaining the ability of the closure cap construction to be instantly put into use by the consumer.

A still further object of the invention is to provide an improved closure cap construction as outlined above, which has a supplementary sealing mechanism operable during shipping and storage, to positively prevent inadvertent, undesirable leakage of the contents, and also to minimize the possibility of contamination thereof resulting from inadvertent entry into the container of external substances or foreign material.

The above objects are accomplished by a slitted membranetype closure comprising a resilient diaphragm having a portion provided with a through slit for the passage of fluids, the slit portion being adapted to bulge and open the slit in response to fluid pressure applied to one side thereof, and the slit portion further having unique abuttable, cooperable means on one side, which come into forcible abutment and act to physically open the slit as the portion bulges.

In a preferred embodiment, the abuttable, cooperable means comprises a ring molded on the underside of the diaphragm and wherein the ring is cut through by the slit in the diaphragm. By such an arrangement there are formed abutment shoulders that pivot the walls of the slit away from one another when the diaphragm is bulged, thereby increasing the size of the opening formed by the slit, and resulting in a more pronounced spreading force being applied to the slit walls. Any hardened or crusted material is dislodged, and the resultant relatively wide opening between the slit walls promotes smooth and even passage of product therethrough.

Other features and advantages will hereinafter appear.

BRIEF DESCRIPTION OF THE DRAWINGS

In the drawings, illustrating several embodiments of the invention:

Referring now to the Figures, FIG. 2 illustrates a handheld dispenser generally designated by the numeral 10, comprising a container 12 having a neck 14, and an external retention bead 16. At the upper end of the mouth there is a lip 18. The container is preferably in the form of a tube or squeeze bottle, such that the product contained therein can be subjected to pressure by external force applied to the container, in the well known manner.

There is illustrated a closure cap construction 20 associated with the container 12, and including a stopper in the form of a resilient, valving-type slitted diaphragm 22 which is responsive to internal pressure in the container, and which is selectively openable in response to an increase in such pressure.

Figure 2:
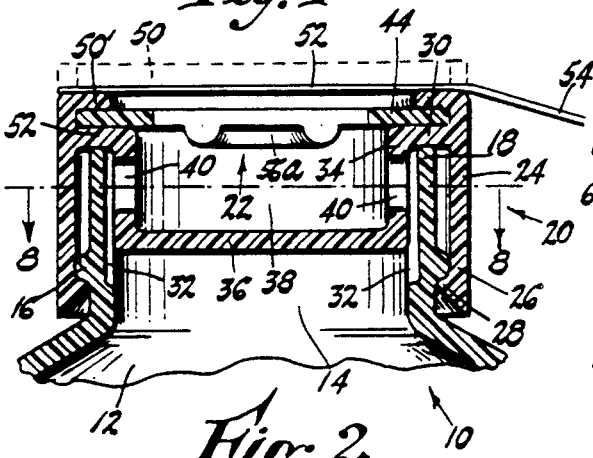
FIG. 2 is an axial section of the closure cap of FIG. 1, and illustrating in addition to a container, a valving diaphragm having a portion containing an elongate slit through which product from the container can flow. The diaphragm rests on an upwardly facing annular seat of the closure cap, and is retained by a crimp formed from an upstanding flange which surrounds the seat.
Figure 8:
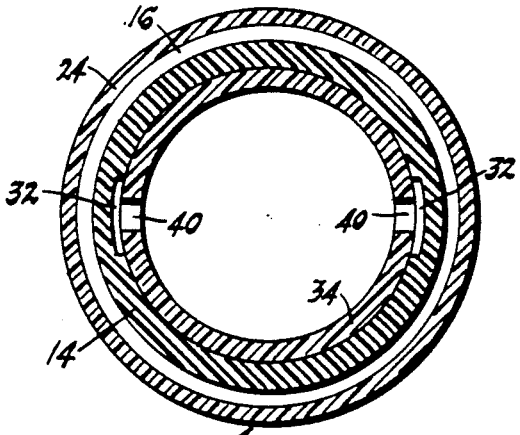
FIG. 8 is a section taken on the line 8—8 of FIG. 2.
Figure 13:
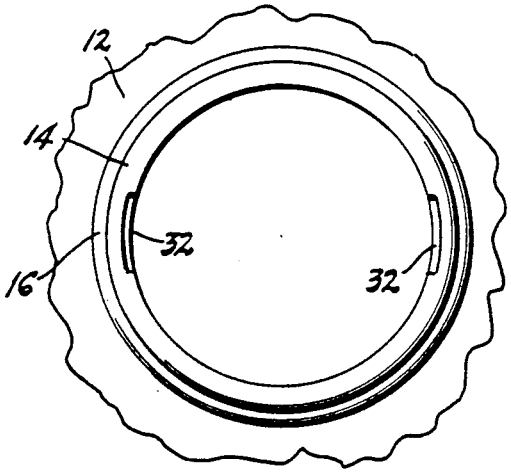
FIG. 13 is a top plan view of the container employed with the closure cap of FIG. 2 and the closure cap of FIG. 10.

In FIG. 2, the closure cap 20 comprises a cap body 24 having a depending skirt 26 with an internal retention bead 28 that snaps over the external retention bead 16 on the neck of the container 12. The lip 18 of the container 12 is engaged by the top wall 30 of the closure cap as shown, and forms a continuous seal with the underside of the closure cap 20. Preferably there are located a pair of internal axially extending recesses 32 on the inside surface of the container 12, which constitute clearance spaces for product flow, as will be explained below. These recesses are particularly illustrated in FIGS. 2, 8 and 13.

The closure cap 20 has a bore formed by an annular side wall 34, and an imperforate bottom wall 36 which defines a central well 38. Preferably two openings or passages 40 are provided in this side wall 34, each being diametrically opposite the other and arranged to align with the respective vertical recess 32 on the neck of the container 12 when the closure cap 20 is rotated to a predetermined relative position with respect to the container 12. The apertured side wall 34 constitutes an orifice portion of the closure cap 20.

The valving diaphragm 22 is disposed across the top of the well 38 and is particularly illustrated in FIGS. 3, 4, 11 and 12. The diaphragm 22 comprises a disk-like body 44 having a portion with a slit 46 extending completely through it. In the illustrated embodiment, the slit 46 is shown as lying along a diametric line of the diaphragm, but other locations for the slit 46 could be employed as well. When the diaphragm 22 is not subjected to stress, the walls 46*a*, 46*b* of the slit are in sealing engagement with one another, and leakage of any product occupying the wall 38 is effectively prevented.

During molding, the closure cap 20 is preferably formed with an upstanding flange 50, shown in dotted outline in FIG. 2. The diameter of the flange 50 is slightly greater than that of the diaphragm 22 such that the latter can be installed on an annular shelf or ledge 52 of the closure cap 20 and thereafter the flange 50 crimped or ultrasonically welded over so as to hold the diaphragm 22 in place. If the material of the closure cap 20 has suitable characteristics, the flange 50 can be stretched over the diaphragm 22, in the manner of a cold flow so as to form a mounting means in the form of a retainer ring 50'. Other means of securing the diaphragm 22 in place can be employed, as will be readily understood.

Figure 1:
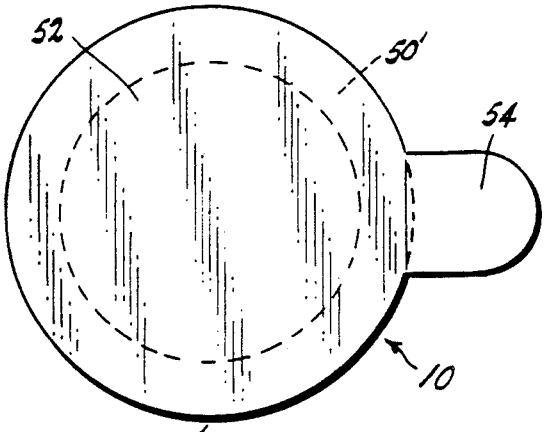
FIG. 1 is a top plan view of the closure cap of the present invention, particularly illustrating an optional tear foil or tear member constituting both a tamper-evident indicator and a seal of the dispenser with which the closure cap is used.
Figure 5:
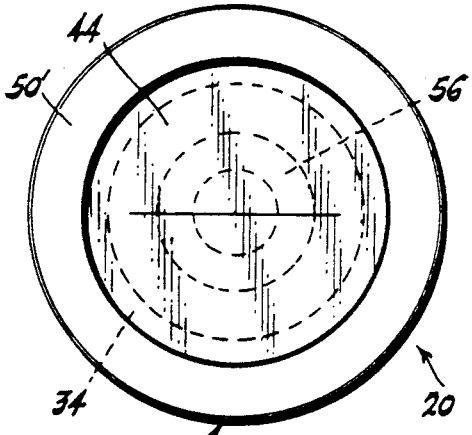
FIG. 5 is a top plan view of the closure cap of FIGS. 1 and 2, with the tear foil or member removed.
Figure 6:
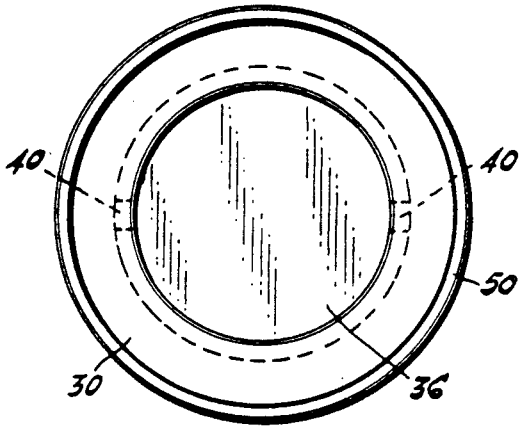
FIG. 6 is a top plan view of the closure cap without the diaphragm installed, and prior to crimping of the peripheral upstanding skirt which retains the diaphragm.
Figure 7:
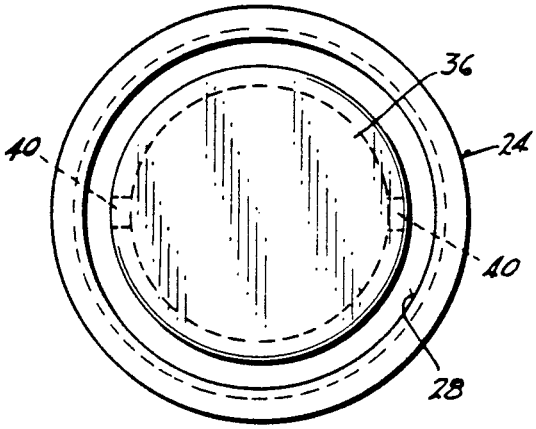
FIG. 7 is a bottom plan view of the closure cap of FIGS. 5 and 6.

A tear foil or member 52 is preferably secured over the ring 50' as in FIG. 2, and has a finger-engageable tab 54 to facilitate its removal prior to use. The foil 52 serves both as an initial sanitary and leak-preventing seal, and as a tamperevident indicator which assures the consumer that the contents are intact, and have not been disturbed prior to initial use. A plan view of the foil 52 is shown in FIG. 1. FIGS. 5–7 illustrate respectively, a top plan view of the closure cap 20 following removal of the foil 52, a top plan view of the closure cap prior to installation of the diaphragm 22, and a bottom plan view of the closure cap.

By the invention the diaphragm 22 has a unique configuration which facilitates its opening in response to internal pressure. As shown in FIGS. 2–4, 11 and 12, such configuration is in the form of protruding abuttable cooperable means on its underside, comprising an abutment formation which functions to spread the walls 46*a*, 46*b* of the slit 46 when the diaphragm 22 is bulged outwardly, thereby to cause an increased separation between the walls 46*a*, 46*b* compared to that which would be realized if a slit of conventional configuration were to be employed. In the disclosed example the abutment formation comprises a protruding ring 56 having a central portion cut through to form the slit 46. The cutting forms a multiplicity of protuberant portions on and integral with the diaphragm 22, in the form of two end-to-end semi-circular ring segments 56*a* and 56*b*, FIG. 11, which are separated from each other by the slit 46. The ends of the ring segments, constituting projections, have abuttable surfaces 58*a*, 58*b* and 59*a*, 59*b*, FIG. 11.

Figure 15:
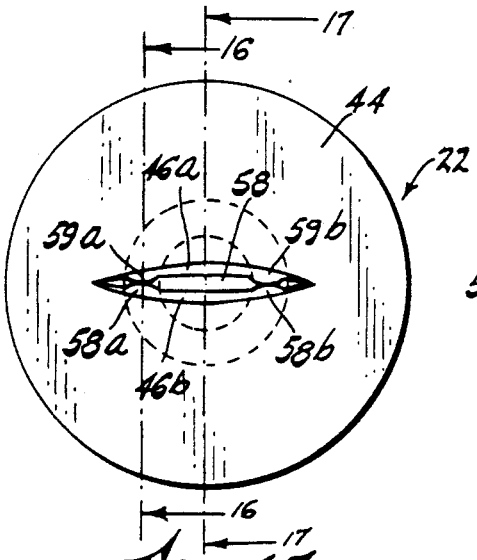
FIG. 15 is a top plan view of the diaphragm of FIGS. 3, 4, 11 and 12, and illustrating the slit in an open condition as it would occupy during discharge of the contents of the container.

During storage or shipping, the closure cap 20 is positioned with the openings 40 out of registration with the recesses 32, so that the closure cap well 38 is effectively sealed, and the dispenser is n"closed". In order to use the dispenser, the consumer first removes the foil 52, and then turns the closure cap 20 with respect to the container 12 such that the openings 40 align respectively with the recesses 32, as in FIGS. 2 and 8. The lip 18 and underside of wall 30 constitute a bearing which permits such turning movement to occur. This "dispensing" or "open" position can be indicated by suitable markings, or by wording applied to the cap and container, such as "To open, align arrows", or other appropriate instructions (not shown). Such turning to the position of FIGS. 2 and 8 establishes communication between the interior of the container 12 and the well 38. If the container 12 is now inverted and squeezed, the resulting pressure of the product in the container is transferred through the recesses 32 and openings 40 to the well 38, causing the diaphragm 22 to bulge outwardly, as in FIGS. 15, 16 and 17, where in the latter two figures, the bulge is indicated as being in a direction toward the left. During such bulging, the semi-circular ring segments 56*a*, 56*b* at their adjacent ends form abutment shoulders (also referred to in the claims as side surfaces of the protuberant portions of the diaphragm) which act to pivot the walls 46*a*, 46*b* of the slit 46 outwardly and away from one another, much as found in a lever action. Thus, the abutment shoulders constitute a means on one side of the diaphragm, for separating the walls of the slit to open the same, said means coming into forcible engagement and acting to physically open the slit as the portion containing the slit bulges. As a consequence, the central opening 58, FIG. 15, formed by the spread-apart walls 46*a*, 46*b* of the slit 46 assumes a generally oval configuration, and the degree of separation between the walls 46*a*, 46*b* and hence the size of this opening 58 is significantly enhanced by the pivoting action of the walls 46*a*, 46*b* about the ends of the semi-circular ring segment 56*a*, 56*b*.

As the diaphragm 22 bulges, product can be discharged through the opening 58. Viscous or cream-like substances will experience reduced resistance to flow, compared with prior dispensers employing a simple slit-like opening. Moreover, the force with which the slit walls 46*a*, 46*b* are separated is significantly increased, such that any tendency for the walls 46*a*, 46*b* to stick together as a consequence of hardened or solidified product is diminished by virtue of the increased force provided by the pivoting action of the ring segments 56*a*, 56*b*.

Figure 16:
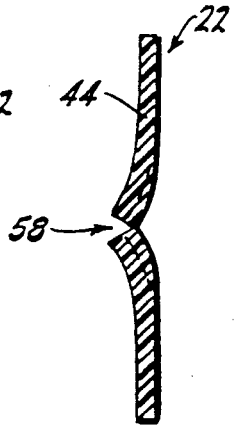
FIG. 16 is a section taken on the line 16—16 of FIG. 15.
Figure 17:
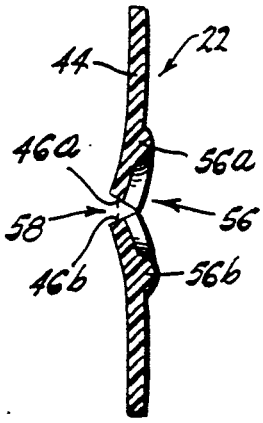
FIG. 17 is a section taken on the line 17—17 of FIG. 15.

FIG. 16 particularly illustrates the slit of the diaphragm 22 at the location of one of the pairs of adjacent cut ends of the ring, whereas FIG. 17 shows a cross section of the walls 46*a*, 46*b* of the slit, and the pivotal or line engagement of the adjacent surfaces of the ring segments 56*a*, 56*b*.

While the disclosed embodiment has been illustrated and described in connection with a ring or bead structure 56*a*, 56*b* on the diaphragm 22, similar results could be obtained with four projection-like abutments (not shown) molded at the underside of the diaphragm 22. The main reason for using a ring is that greater flexibility can be had as to the lack of a required angular orientation of the slit. Stated differently, the slit 46 can be incorporated in the diaphragm in virtually any angular position, since the ring is symmetrical about the axis of the closure cap 20; thus the slit through the ring 56 can be formed at the same time as the slit through the diaphragm 22 without regard to the angular disposition of the latter. The slits can be either molded in the diaphragm, or else formed by a cutting tool after the diaphragm is molded.

The material of which the closure cap is constituted can be polypropylene or its equivalent, whereas the diaphragm is preferably constituted of either a silicone rubber or TPE (thermoplastic elastomer).

Figure 9:
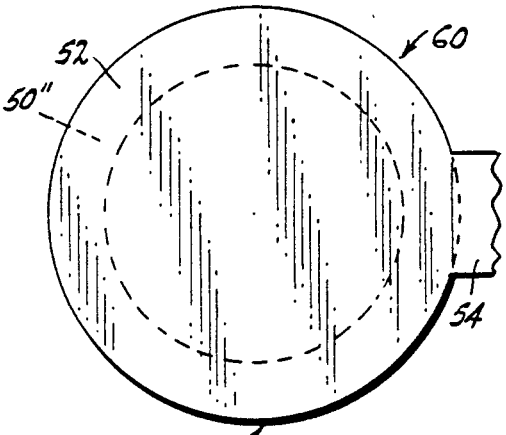
FIG. 9 is a top plan view similar to that of FIG. 1, of a modified closure cap, constituting another embodiment of the invention.
Figure 10:
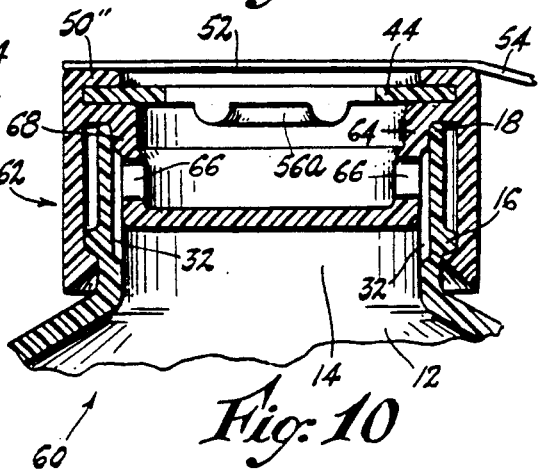
FIG. 10 is an axial section similar to that of FIG. 2, of the modified construction of FIG. 9.
Figure 3:
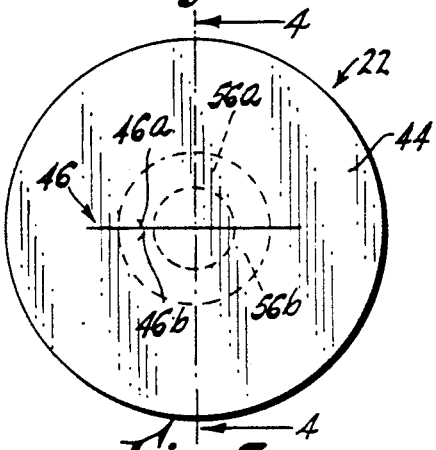
FIG. 3 is a top plan view of the valving diaphragm employed with the closure cap of FIGS. 1 and 2.
Figure 11:
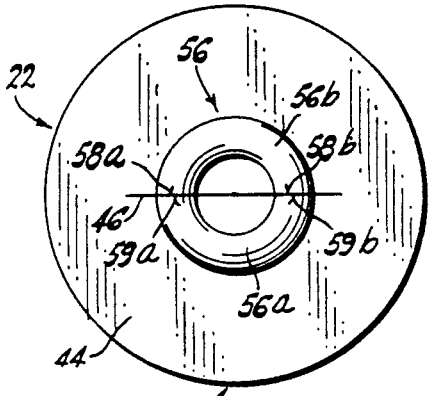
FIG. 11 is a bottom plan view of the valving diaphragm of FIGS. 3 and 4.
Figure 4:
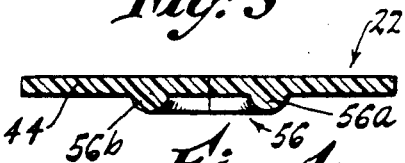
FIG. 4 is a section taken on the line 4—4 of FIG. 3.
Figure 12:
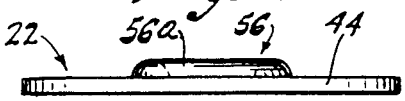
FIG. 12 is a side elevation of the diaphragm of FIGS. 3, 4 and 11.
Figure 14:
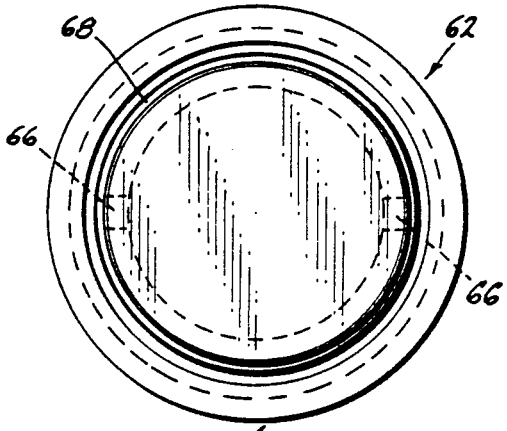
FIG. 14 is a bottom plan view of the modified closure cap of FIG. 10.

Another embodiment of the invention is illustrated in FIGS. 9, 10 and 14, showing a somewhat modified closure cap construction 60. A container 12 is provided, having the same structure as that of FIG. 2. The closure cap 60 has a cap body 62 with an inward crimp 50" and with an annular inside wall 64 containing side openings 66 intended to align with the recesses 32 in the inner surface of the neck of the container 12. By the invention there is provided an expanded seal between the container 12 and the closure cap 62, which seal is intended to be effective for all rotative positions of the closure cap 62. In accomplishing the improved seal, there is provided a step or shoulder 68 on the outside of the wall 64 of the closure cap 62, and the outer surface of the shoulder 68 is of roughly the same diameter as that of the neck of the container 12 to enable the shoulder 68 to fit telescopically in the container neck. Accordingly, seals are established between not only the upper surface of the lip 18 of the container 12 and a top wall of the closure cap, but also between the inner diameter of the container neck and the outer surface of the shoulder 68. This double seal effectively inhibits product flow past the shoulder 68 and toward the container lip 18.

The remainder of the closure cap of FIG. 10 is substantially the same as that of FIG. 2 with respect to the diaphragm 22, its retention, and the tear foil or seal member 52.

Figure 18:
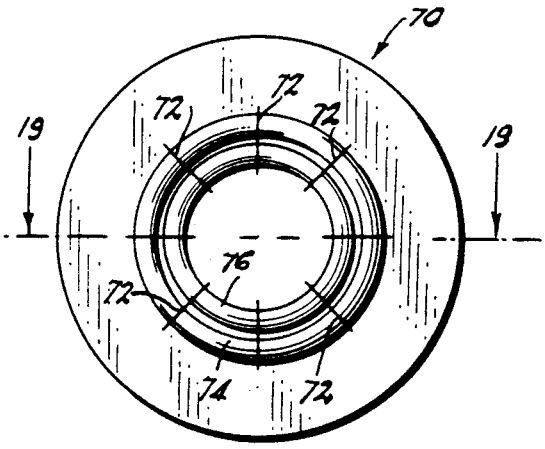
FIG. 18 is a bottom plan view of a modified valving diaphragm for use in with the closure cap of FIG. 2, or with the closure cap of FIG. 10, constituting another embodiment of the invention.
Figure 19:
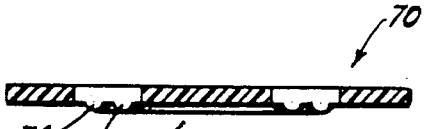
FIG. 19 is a section taken on the line 19—19 of FIG. 18.

Still another embodiment of the invention is illustrated in FIGS. 18 and 19, wherein there is provided a modified diaphragm 70 having multiple slits 72. By the invention the slits 72 are disposed along radii, six such slits 72 being indicated in the one figure. Also by the invention, there is provided a pair of concentric rings 74, 76 molded integral with the diaphragm 70, and the slits are formed to extend completely through the rings at the six locations.

The diaphragm 70 of FIGS. 18 and 19 is intended to be substituted for the diaphragm 22 shown in FIG. 2 or that in FIG. 10. In operation, as pressure is applied to the underside of the diaphragm 70 it bulges outwardly in the manner of FIGS. 16 and 17, and the segments of each ring 74, 76 effect a pivoting of the walls of the slits away from one another, in the manner of FIG. 15. As a consequence, the walls of each of the six slits experience a pronounced separation, forming six discharge passages through which product can flow. Where increased flow capacity or distributed product discharge is desired, the diaphragm 70 of FIGS. 18 and 19 can be employed in place of that of FIG. 2 or FIG. 10, as dictated by the particular application, and the nature of the product being dispensed.

Figure 20:
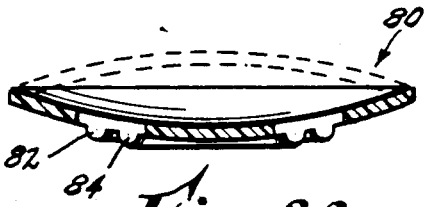
FIG. 20 is a section like that of FIG. 19, illustrating a further modified diaphragm normally having an upwardly facing concave shape. The diaphragm is intended to reverse its curvature from the solid outline position to the dotted outline position under the influence of pressure applied thereto by the contents of the container as the latter is squeezed.

Still another embodiment of the invention is illustrated in FIG. 20, showing a further modified diaphragm 80. By the invention the diaphragm 80 is molded with an upwardly-facing concave configuration, and it retains this configuration when installed in the closure cap. As in the embodiment of FIGS. 18 and 19, two concentric molded rings 82, 84 are disposed on the underside of the diaphragm, and a single central slit extends through the diaphragm and rings. The walls of the slit are engaged with one another in the position shown in solid outline in this figure. Upon the application of pressure applied to the underside of the diaphragm 80, the latter will bulge upwardly to the dotted outline position, causing outward pivoting of the walls of the slit. Upon release of the pressure, the resilience of the diaphragm will restore it to the solid outline position. In addition, during such release there will occur an inrush of air through the slit as it is closing, thus aiding in the restoration of normal pressure in the container. This is considered to have an important advantage in that it would reduce any tendency for the container to collapse with each discharge as a result of inadequate venting of air into the container to replace the product which has been removed.

Figure 21:
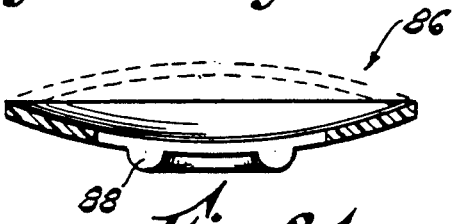
FIG. 21 is a section like that of FIG. 19, illustrating a still further modified diaphragm normally also having an upwardly facing concave shape. The diaphragm is intended to reverse its curvature from the solid outline position to the dotted outline position under the influence of pressure applied thereto by the contents of the container as the latter is squeezed.

Yet another embodiment of the invention is shown in FIG. 21, which illustrates a further modified diaphragm 86 that is molded to have an upwardly-facing concave configuration. The diaphragm has a single molded ring 88 at its underside, and the slit in the diaphragm extends completely through it and through the ring, so as to form abutment shoulders at the abutting ends of the ring. In other respects, the construction is similar to that of FIG. 20. The diaphragm 86 is intended to be substituted for the diaphragm 22 in the embodiment of FIG. 2 or the embodiment of FIG. 10.

Figure 22:
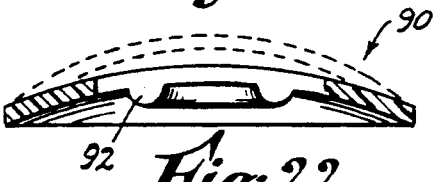
FIG. 22 is a section like that of FIG. 19, illustrating yet a further modified diaphragm normally having an upwardly facing convex shape. The diaphragm is intended to bulge from the solid outline position to the dotted outline position under the influence of pressure applied thereto by the contents of the container as the latter is squeezed.

Still another embodiment of the invention is shown in FIG. 22. A further modified diaphragm 90 having a ring 92 is provided, intended to be substituted for the diaphragm 22 of FIG. 2 or that of FIG. 10. By the invention, the diaphragm 90 has an downwardly-facing concave configuration, and occupies the solid outline position when the container is in storage. In use, the application of pressure to the underside causes an upward bulging of the diaphragm, to the dotted outline position in this figure; at the same time, the engagement of the abutting surfaces of the ring 92 causes outward pivoting of the walls of the slit, thereby increasing the size of the opening formed by the slit during dispensing. Upon release of pressure, the diaphragm returns to the solid outline position. The disclosed construction is believed to be applicable where it is desired to open the slit with a minimal pressure, since the diaphragm is already in a semi-bulged state when the container is not being squeezed.

From the above it can be seen that I have provided novel and improved closure cap constructions which are characterized by significantly enhanced dispensing characteristics by virtue of pivoting structures on the underside of a slitted diaphragm, which structures result in wider opening of the slit for a given displacement of the diaphragm. The disclosed devices can be readily molded in relatively straightforward mold cavities, thereby maintaining the overall expense as low as possible. Provision is made to adapt different style diaphragm configurations to suit various applications, according to the desired size of the discharge openings, and the viscosity of the material being dispensed. The devices as disclosed are thus seen to represent a distinct advance and improvement in the field of closures for tubes, squeeze bottles and the like.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty o validity.

What is claimed is:

1. A valving-type closure comprising a resilient diaphragm having a potion provided with a through valving slit which has opposed engaging walls for restricting the passage of fluids therethrough, said slitted portion being adapted to bulge and open said slit in response to fluid pressure applied to one side thereof, and said slitted portion having protruding abuttable, cooperable means on said one side, for separating the walls of said slit to open the same, said means coming into forcible abutment and acting to physically open the slit as the said slitted portion bulges.

2. A dispensing cap for a hand-held container, comprising in combination:

a) a cap body having means for retaining the same on the neck portion of the container, said body having a bore and an orifice portion connecting with said bore, b) a stopper adapted to be carried by said cap body for closing the orifice portion of the body, said stopper comprising a valving-type resilient diaphragm having a portion provided with a through slit for the passage of fluids therethrough, said slitted portion being adapted to bulge and open said slit in response to fluid pressure applied to one side thereof, and said slitted portion having protruding abuttable, cooperable means disposed on said one side and within the cap body, which come into forcible abutting engagement and act to physically open the slit as the said slitted portion bulges, and c) means engageable with peripheral portions of said diaphragm, mounting the diaphragm across the bore of the cap body.

3. A closure as set forth in claim 1, wherein:

a) said cooperable means comprises a multiplicity of protuberant portions on and integral with the diaphragm.

4. A closure as set forth in claim 1, wherein:

a) said cooperable means and comprises two pairs of projections on and integral with the diaphragm, b) the projections of each said pair being mutually cooperable and engageable to effect opening of said slit.

5. A closure as set forth in claim 3, wherein:

a) said protuberant portions have pairs of flat, cooperable and mutually engaging side surfaces which are pressed into firm contact with each other when the diaphragm bulges.

6. A closure as set forth in claim 1, wherein:

a) said diaphragm is constituted of a resilient synthetic material.

7. A closure as set forth in claim 6, wherein:

a) said synthetic material is a silicone rubber.

8. A closure as set forth in claim 2, wherein:

a) said means mounting the diaphragm comprises portions of the cap body which are crimped over the diaphragm.

9. A closure as set forth in claim 1, wherein:

a) said diaphragm has a bowed configuration.

10. A closure as set forth in claim 1, wherein:

a) said diaphragm has a bowed configuration facing concave upwardly.

11. A closure as set forth in claim 1, wherein:

a) said diaphragm has a bowed configuration facing concave downwardly.

12. A closure construction as in claim 2, wherein:

a) said container has an annular lip, b) said cap body having a transverse top wall slidingly and sealingly engageable with said lip, c) said cap body having an annular wall telescopically received in the container, said annular wall having a sealing portion slidably and sealingly engageable with the inner surface of the container adjacent said lip, to prevent product from reaching said lip.

13. A valving-type closure comprising a resilient diaphragm having a portion provided with a through slit for the passage of fluids therethrough, said slit portion being adapted to bulge and open said slit in response to fluid pressure applied to one side thereof, and said portion having protruding abuttable, cooperable means on said one side, which some into forcible abutment and act to physically open the slit as the said portion bulges, said cooperable means comprising a raised ring having a cut-through portion which presents abuttable surfaces.

14. A closure as set forth in claim 13, wherein:

a) said cooperable means comprises an additional raised ring concentric with the first raised ring.

15. A closure as set forth in claim 13, wherein:

a) said diaphragm comprises a disk, and b) said diaphragm having multiple slits extending along radial lines of said disk.

16. A closure as set forth in claim 15, wherein:

a) said cooperable means comprises an additional raised ring having cut-through portions presenting additional abuttable surfaces.

17. A dispensing cap for a hand-held container, comprising in combination:

a) a cap body having means for retaining the same on the neck portion of the container, said body having a bore and an orifice portion connected to said bore, b) a stopper adapted to be carried by said cap body for closing the orifice portion of the body, said stopper comprising a valving-type resilient diaphragm having a portion provided with a through slit for the passage of fluids therethrough, said diaphragm portion being adapted to bulge and open said slit in response to fluid pressure applied to one side thereof, and said portion having protruding abuttable, cooperable means on said one side, which come into forcible abutment and act to physically open the slit as the said portion bulges, c) means engageable with peripheral portions of said diaphragm, mounting the diaphragm across the bore of the cap body, d) said means mounting the diaphragm comprising portions of the cap body which are crimped over the diaphragm, and e) a tear foil sealingly attached to said crimped portions of the cap body, isolating the diaphragm and its through slit from the exterior of the container.

18. A valving-type closure comprising a resilient diaphragm having a portion provided with a through slit for the passage of fluids therethrough, said slit portion being adapted to bulge and open said slit in response to fluid pressure applied to one side thereof, and said portion having protruding abuttable, cooperable means on said one side, which come into forcible abutment and act to physically open the slit as the said portion bulges, b) said cooperable means comprising a raised ring having a cut-through portion which presents abuttable surfaces, c) said diaphragm comprising a disk, and said raised ring being centrally disposed in said disk.

19. A closure as set forth in claim 18, wherein:

a) said slit lies along a diametric line of the disk, and said ring comprises two substantially semi-circular upstanding ring elements.

20. A closure as set forth in claim 18, wherein:

a) said slit extends radially beyond the ring.

* * * * *

UNITED STATES PATENT AND TRADEMARK OFFICE

CERTIFICATE OF CORRECTION

PATENT NO. : 5,071,017

DATED : Dec. 10, 1991

INVENTOR(S) : Gene Stull

It is certified that error appears in the above-identified patent and that said Letters Patent is hereby corrected as shown below:

Title page, item [19], "StulI" should read --Stull--.

Title page, item [76], "Iene StulI" should read --Gene Stull--.

Signed and Sealed this

Thirtieth Day of March, 1993

*Attest:*

STEPHEN G. KUNIN

*Attesting Officer*

*Acting Commissioner of Patents and Trademarks*